United States Patent [19]

Zon et al.

[11] Patent Number: 4,876,020

[45] Date of Patent: Oct. 24, 1989

[54] LUBRICATING OIL COMPOSITION

[75] Inventors: Arie Van Zon; Brian Coleman, both of Amsterdam, Netherlands

[73] Assignee: Shell Oil Company, Houston, Tex.

[21] Appl. No.: 209,607

[22] Filed: Jun. 21, 1988

[30] Foreign Application Priority Data

Jun. 25, 1987 [GB] United Kingdom ..... 8714922

[51] Int. Cl.[4] ..... C10M 129/50; C10M 129/54

[52] U.S. Cl. ..... 252/40.5; 252/39; 252/52 A

[58] Field of Search ..... 252/52 A, 39, 40.5

[56] References Cited

U.S. PATENT DOCUMENTS

| | | | |
|---|---|---|---|
| 2,865,956 | 12/1958 | Ellis et al. | 252/39 |
| 2,951,808 | 9/1960 | Norton et al. | 252/39 |
| 3,223,627 | 12/1965 | Vesterdal | 252/39 |
| 3,625,893 | 12/1971 | Brook et al. | 252/39 |
| 3,704,315 | 11/1972 | Strang | 252/39 |
| 3,761,404 | 9/1973 | Calow et al. | 252/39 |
| 4,278,555 | 7/1981 | Zaweski et al. | 252/52 |
| 4,426,301 | 1/1984 | Dexheimer et al. | 252/52 A |
| 4,493,776 | 1/1985 | Rhodes | 252/52 |
| 4,539,126 | 9/1985 | Bleeker et al. | 252/39 |
| 4,627,928 | 12/1986 | Karn | 252/39 |
| 4,719,023 | 1/1988 | MacPhail et al. | 252/39 |
| 4,752,405 | 6/1988 | Kyle et al. | 252/52 A |

FOREIGN PATENT DOCUMENTS

| | | | |
|---|---|---|---|
| 168110 | 1/1986 | European Pat. Off. . | |
| 168111 | 1/1986 | European Pat. Off. . | |
| 168880 | 1/1986 | European Pat. Off. . | |
| 248465 | 12/1987 | European Pat. Off. . | |
| 2279839 | 2/1976 | France . | |
| 38794 | 3/1983 | Japan | 252/52 A |
| 786167 | 11/1957 | United Kingdom . | |
| 818325 | 8/1959 | United Kingdom . | |
| 853535 | 11/1960 | United Kingdom . | |
| 2149810 | 6/1985 | United Kingdom . | |

OTHER PUBLICATIONS

Hawley, The Condensed Chemical Dictionary, pp. 831–833.

*Primary Examiner*—William R. Dixon, Jr.
*Assistant Examiner*—Ellen M. McAvoy

[57] ABSTRACT

Lubricating oil composition comprising a lubricating base oil, one or more overbased alkaline earth metal salts of an aromatic carboxylic acid, and a stabilizing agent which has been selected from a polyalkoxylated alcohol having a molecular weight from 150 to 1500.

18 Claims, No Drawings

LUBRICATING OIL COMPOSITION

FIELD OF THE INVENTION

The present invention relates to a lubricating oil composition comprising a lubricating base oil, one or more overbased metal salts of a carboxylic acid and a stabilizing agent.

BACKGROUND OF THE INVENTION

It is well known to use oil-soluble overbased metal salts of carboxylic acids as detergent additives in lubricating oils. The basicity of the salts does not only improve the detergent properties of the oils but it also provides the oils with an alkaline reserve which neutralizes any acidic compound which is formed during the operation of the engine in which the lubricating oil composition is used.

Solutions of oil-soluble overbased salts in a lubricating base oil sometimes have a tendency to gel. It is evident that this gelling tendency may lead to difficulties when such solutions are used in practice. This problem has been known in the art for a long time and in GB-A-No. 818,325 a solution is proposed. This patent specification proposes to add an oil-soluble compound which contains a polar group to the composition. Examples of such compounds are mono- or polyhydric alcohols such as methanol, hexanol and decanol, alkylamines such as decylamine, alkyl phenol, alkyl aromatic carboxylic acids and hydrocarboxylic acids, aliphatic carboxylic acid, naphthenic acids, sulphonic acids, phosphoric acids and their salts. From the Examples in this reference it is apparent that considerable amounts of these compounds are required to get the desired result, especially in the case of overbased alkaline earth metal salts. Further, the use of a carboxylic acid as a stabilizing agent, as is described in Examples of the British patent specification, reduces the overall basicity, calculated as the total equivalent of metal over the total equivalent of acid, thereby decreasing the desirable alkaline reserve. Hence such stabilizing agents are not satisfactory.

Applicants have now found that other compounds which do not necessarily have to fulfil the requirement set by GB-A-No. 818,325, i.e. that they have a polar group and an oleophilic group, stabilise lubricating oil compositions, even at low concentrations, without reducing the alkaline reserve in solutions of overbased salts.

SUMMARY OF THE INVENTION

Accordingly the present invention provides a lubricating oil composition comprising a lubricating base oil, one or more overbased alkaline earth metal salts of an aromatic carboxylic acid and a stabilizing agent, which has been selected from a polyalkoxylated alcohol having a molecular weight of about 150 to about 1500.

The lubricating base oils present in the compositions of the invention are preferably hydrocarbon lubricating oils, which can be mineral or synthetic, but ester-type lubricating base oils and vegetable oils can also be used. The compositions can also contain mixtures of lubricating base oils. An example of such a mixture is a mixture of mineral lubricating oils, for instance a mixture of a distillate lubricating oil and a residual lubricating oil. Another example of such a mixture is a mixture of a mineral lubricating oil and a synthetic hydrocarbon lubricating oil. As examples of suitable synthetic hydrocarbon lubricating oils include conventional polymers of olefins with 2 to 6 carbon atoms, e.g. polyisobutylenes. Preferably the lubricating base oil component of the compositions according to the invention is a mineral lubricating oil or a mixture of mineral lubricating oils. The viscosity of the lubricating base oils present in the lubricating oil compositions can vary within wide ranges, and is generally from about 3 to about 35 cSt ($mm^2/s$) at 100° C.

Suitable aromatic carboxylic acids include acids containing a benzene or naphthalene ring and one or more oil-solubilising radicals having a total of at least 8, in particular at least 12 carbon atoms. Particularly preferred are alkyl salicylic acids having at least 10 carbon atoms in the alkyl group, in particular from 12 to 26 carbon atoms.

The alkaline earth metals used in the present composition include magnesium, calcium, strontium and barium or mixtures thereof. Preferably, the alkaline earth metal employed is magnesium, calcium, or mixtures thereof. The preparation of overbased metal salts has been described in several patent documents, e.g. GB-A-No. 786,167 and in the pending British applications Nos. 8627130 and corresponding U.S. application, Ser. No. 113,299 and European patent No. 248,465. In the present composition by an overbased metal salt is understood any salt in which the basicity index (BI), defined as the equivalent ratio of metal to aromatic carboxylic acid is greater than 1. The BI of the salt used is preferably from 3 to 20. By the term "overbased metal salt" is further understood any metal salt which before or after overbasing has been subjected to a further treatment, e.g. a sulphurization and/or boration step, such as those described in EP-A-No. 0,168,110, EP-A-No. 0,168,111, EP-A-No. 0,168,880 and GB-B-No. 2,149,810.

The stabilizing agent used according to the present invention is a polyalkoxylated alcohol. The alcohol can be selected from aliphatic, cycloaliphatic, heterocyclic and aromatic alcohols. Suitable examples of alcohols include $C_{1-20}$ alkanols, diols such as glycol and propyleneglycol and triols, such as glycerol. When, a glycol is alkoxylated a polyalkylene glycol is obtained. Such a compound is included in the definition of polyalkoxylated alcohol. Also copolymers of different glycols, such as ethylene and propylene glycol, are covered by this definition. Cyclohexanol and cyclopentanol are suitable cycloaliphatic alcohols. Suitable heterocyclic alcohols include hydroxy-group(s)-containing tetrahydrofuran and tetrahydropyran. The most preferred aromatic alcohol is phenol. The alcohols, in particular the aromatic, cycloaliphatic and heterocyclic alcohols preferably contain oil-solubilizing radicals, such as a $C_{5-30}$, preferably $C_{8-12}$, alkyl or a $C_{7-30}$, preferably $C_{12-22}$, acyl group.

The number of alkoxy groups in the polyalkoxylated alcohol can vary, and is chosen such that the compound is oil-soluble. Hence, when the alcohol is oil-soluble or almost oil-soluble, the number of alkoxy groups is preferably at least 2, whereas for the low-molecular weight alcohols the number of alkoxy groups will be chosen higher to render the compound oil-soluble. For alcohols which contain an oil-solubilizing radical as mentioned above, the number of alkoxy groups is preferably from 3 to 15. The preferred alkoxy group is ethoxy, although other alkoxy groups such as propoxy, butoxy or pentoxy groups can also be used.

The stabilizing agent should have a molecular weight of from about 150 to about 1500. It is appreciated that commercially available compounds may contain a mixture of homologues. In that case the average molecular weight should be from about 150 to about 1500. Preferably the (average) molecular weight of the stabilizing agent is from about 350 to about 1000. Most preferred are stabilizing agents having a molecular weight from about 550 to about 650.

Preferred stabilizing agents include polyethoxylated $C_{8-15}$ alkanols, containing 4–10 ethoxy groups, polyethoxylated $C_{8-10}$ alkyl phenol, having 8–10 ethoxy groups, polyethylene glycol, being polyethoxylated glycol, having a molecular weight from about 200 to about 1000.

In preparing the lubricating oil composition according to the invention it is convenient to add the stabilizing agent to a mixture of the overbased salt and the lubricating base oil. However, it is advantageous to add the stabilizing agent to the mixture comprising alkyl salicylic acid and calcium hydroxide or oxide, from which the overbased metal is prepared (cf. e.g. GB-A-No. 786,167).

The lubricating oil composition according to the present invention can contain the stabilizing agent in various amounts. Preferably, the composition contains from about 0.005 to about 2.0% w of the stabilizing agent. The amount of the overbased salts can also vary within wide ranges, dependent on the use of the lubricating oil composition. When the composition is used in marine lubricants the lubricating oil composition preferably contains from about 5 to about 20% w of the overbased salt. In lubricating oil compositions for road engines the amount of the overbased salt is preferably from about 0.5 to about 5.0% w, all weight percentages being based on the total weight of the lubricating base oil, overbased salt and stabilizing agent.

The lubricating composition according to the invention is suitably prepared by addition of an additives concentrate to a lubricating base oil. Such a concentrate generally comprises a lubricating base oil as solvent/diluent and one or more additives in a concentrated form. Hence the present invention further provides a lubricating oil concentrate comprising a lubricating base oil, up to about 60% w of overbased salt, and from about 0.5 to about 5.0% w of the stabilizing agent, all weight percentages based on the weight of the lubricating base oil, overbased salt and stabilizing agent.

The lubricating oil composition may further contain a number of other additives, such as antioxidants, foam inhibitors, corrosion inhibitors, viscosity index improvers, ashless dispersants and pour point depressants, as can be established by a person skilled in the art.

The invention will be illustrated by means of the following Examples which should not be regarded as limiting the invention in any way.

EXAMPLE 1

The performance of a number of compounds was tested in a lubricating oil concentrate containing the following components:

a hydrocarbon mineral base oil having a kinematic viscosity at 100° C. of 4.4–4.9 $mm^2/s$;

40% w of an overbased calcium $C_{14-18}$ alkyl salicylate, having a basicity index of 13.5, the calcium content being 10% w;

2% w of a stabilizing agent, all weight percentages based on the weight of the mineral base oil, salicylate and stabilizing agent.

The kinematic viscosity of the mixture at 100° C. was determined one day after mixing the components and after storage of 5 days at 140° C.

The stabilizing agent used, its (average) molecular weight and the results are indicated in Table I below.

TABLE I

| Stabilizing agent | Mw | $V_k$ at 100° C. ($mm^2/s$) 1 day | 5 days |
|---|---|---|---|
| none | — | 518 | solid |
| ethoxylated $C_{9-11}$ alkanols having 5 ethoxy groups | 380 | 69.4 | 104 |
| ethoxylated $C_{12-15}$ alkanols having 9 ethoxy groups | 609 | 86.2 | 155 |
| ethoxylated p-nonyl-phenol having 9.5 ethoxy groups | 638 | 78.0 | 97.0 |
| polyethylene glycol | 200 | 141 | 990 |
| " | 400 | 144 | 1080 |
| " | 600 | 145 | 485 |
| " | 1000 | 227 | 845 |

To show that stabilizing agents having a molecular weight above 1500 do not perform properly, a block copolymer of ethylene glycol and propylene glycol (Mw 3610) was subjected to the same test as described above. A viscous gel was obtained after 1 day.

EXAMPLE 2

The stabilizing performance of a number of compounds was tested in a lubricating oil composition containing the following compounds:

10.3% w of an oil concentrate comprising borated overbased magnesium $C_{14-18}$ alkyl salicylate having a magnesium content of 5.8% w, a boron content of 2.7% w and a BI of 6.7, the boration having been carried out according to GB-B-2,149,810;

0.2% w of the stabilizing agent; and 89.5% w of a mineral lubricating base oil mixture.

The stability of the composition was determined by storing the composition at 100° C. and recording the amount of deposits formed after 2 and 7 days in % v/v. The results of the tests are given in Table II.

TABLE II

| Stabilizing agent | Mw | Deposits, %v/v 2 days | 7 days |
|---|---|---|---|
| ethoxylated $C_{9-11}$ alkanols having 5 ethoxy groups | 380 | 0 | 0 |
| ethoxylated p-nonyl-phenol having 9 ethoxy groups | 609 | 0 | 0 |
| polyethylene glycol | 600 | 0 | <0.05 |

For comparison purposes the same test was done using a mixture of 10.3% w of the above concentrate with the borated salt and 89.7% w of the above lubricating base oil mixture. Already after 2 days 3% v/v of deposits were formed.

EXAMPLE 3

Gelling of an oil composition containing an overbased salt also occurs at exposure to a human atmosphere. At the contact surface of the oil composition and the atmosphere a viscous skin is formed. To show the stabilizing performance of a number of compounds compositions similar to those of Example 1, the only difference being the use of an alkyl salicylate with a BI of 8, were subjected to storage at room temperature and at a relative humidity of 98%. Without the addition of a stabilizing agent skin formation occurred after about 1 hour.

Addition of 2% w of a stabilizing agent had a favourable effect as is apparent from Table III.

TABLE III

| Stabilizing agent | Mw | Skin formation after |
|---|---|---|
| polyethylene glycol | 200 | 2 days |
| polyethylene glycol | 400 | 1 day |
| ethoxylated p-nonylphenol having 9.5 ethoxy groups | 638 | 1 day |

EXAMPLE 4

An overbased calcium $C_{14-18}$ alkyl salicylate was prepared by adding polyethylene glycol (Mw 600) to the starting mixture. Hence, 250.0 g of $C_{14-18}$ alkyl salicylic acid, 453.8 g of xylene and 177.2 g of calcium hydroxide were heated at 40° C. and subsequently 58.7 g of the polyethylene glycol and 19.5 g of water were added. After raising the temperature of the mixture to 65° C. carbon dioxide was introduced into the mixture until about 12 equivalent $CO_2$ per equivalents acid had been taken up. After stirring the mixture overnight the mixture was centrifuged and filtered leaving a xylene solution containing 8.4% of calcium and a BI of 13.7. The xylene solution was mixed with a mineral lubricating base oil, the xylene was evaporated, leaving an oil concentrate having a calcium content of 9.84% w, a BI of 13.7 and a kinematic viscosity at 100° C. of 14.2 cSt ($mm^2/s$).

The concentrate obtained was subjected to the same test as described in Example 3 and no skin formation was observed after 7 days storage at a relative humidity of 98%.

What is claimed is:

1. A lubricating oil composition comprising hydrocarbon a lubricating base oil, one or more overbased alkaline earth metal salts of an aromatic carboxylic acid effective to improve the detergent properties of the composition and an effective amount of a stabilizing agent which is selected from polyalkoxylated alcohol having a molecular weight of 150–1500.

2. The composition according to claim 1, in which the lubricating base oil is a mineral or synthetic hydrocarbon lubricating oil.

3. The composition according to claim 1, in which the aromatic carboxylic acid is an alkyl salicyclic acid in which the alkyl group has at least 8 carbon atoms.

4. The composition according to claims 1 or 3, in which the alkaline earth metal is magnesium, calcium or mixtures thereof.

5. The composition according to claims 1 or 3, in which the stabilizing agent is a polyalkoxylated aliphatic, cycloaliphatic, heterocyclic or aromatic alcohol.

6. The composition according to claim 5, in which the alcohol contains an oil solubilizing radical selected from $C_{5-30}$ alkyl and $C_{7-30}$ acyl groups.

7. The composition according to claim 6, in which the number of alkoxy groups in the stabilizing agent is from 3 to 15.

8. The composition according to claim 7, in which the polyalkoxylated alcohol is a polyethoxylated alcohol.

9. The composition according to claim 8, in which the molecular weight of the stabilizing agents is from 350 to 1000.

10. The composition according to claim 9, in which the stabilizing agent is selected from polyethoxylated $C_{8-15}$ alkanols containing 4–10 ethoxy groups, polyethoxylated $C_{8-10}$ alkyl phenols, having 8–10 ethoxy groups and polyethylene glycols, having a molecular weight from 200 to 1000.

11. The composition according to claim 1, containing a lubricating base oil, from 0.5 to 20% w of the overbased metal salt and from 0.005 to 2.0% w of a stabilizing agent, all weight percentages being based on the total weight of the lubricating base oil, overbased metal salt and stabilizing agent.

12. Lubricating oil concentrate, comprising hydrocarbon base oil or ester mixtures thereof as a base oil containing up to 60% w of an overbased alkaline earth metal salt of an aromatic carboxylic acid and from 0.5 to 5.0% w of a stabilizing agent which is selected from polyalkoxylated alcohols having a molecular weight of 150–1500, all weight percentages being based on the weight of the lubricating base oil, overbased metal salt and stabilizing agent.

13. The composition according to claim 12 wherein the aromatic carboxylic acid is an alkyl salicyclic acid in which the alkyl group has at least 8 carbon atoms.

14. The composition according to claim 13 wherein the alkaline earth metal is magnesium, calcium or mixtures thereof.

15. The composition according to claim 12 or 13 wherein the stabilizing agent is a polyalkoxylated alcohol containing an oil solubilizing radial selected from $C_{5-30}$ alkyl and $C_{7-30}$ acyl groups.

16. The composition according to claim 15 wherein the number of alkoxy groups in the stabilizing agent is from 3 to 15.

17. The composition according to claim 16 wherein the polyalkoxylated alcohol is a polyethoxylated alcohol.

18. The composition according to claim 17 wherein the stabilizing agent is selected from polyethoxylated $C_{8-15}$ alkanols containing 7–10 ethoxy groups, polyethoxylated $C_{8-10}$ alkyl phenols having 8–20 ethoxy groups and polyethylene glycols having a molecular weight of from 200 to 1000.

* * * * *